US005542333A

United States Patent [19]

Hagelberg et al.

[11] Patent Number: 5,542,333

[45] Date of Patent: Aug. 6, 1996

[54] UNDERSEA VEHICLE EJECTION FROM CAPSULES

[75] Inventors: Allen C. Hagelberg, Diamond Bar; Clark E. Allardt, Claremont, both of Calif.

[73] Assignee: Hughes Missile Systems Company, Los Angeles, Calif.

[21] Appl. No.: 523,477

[22] Filed: Aug. 15, 1983

[51] Int. Cl.[6] ..... F41F 3/10; B65D 53/00

[52] U.S. Cl. ..... 89/1.81; 89/1.816; 220/358; 220/378

[58] Field of Search ..... 89/1.81, 1.819, 89/1.809, 1.816, 1.817, 1.818, 1.8; 220/319, 357, 358, 378

[56] References Cited

U.S. PATENT DOCUMENTS

| | | | |
|---|---|---|---|
| 2,666,092 | 1/1954 | Balzer | 220/378 X |
| 2,709,092 | 5/1955 | Wallace | 220/378 X |
| 2,910,209 | 10/1959 | Nelson | 220/378 |
| 3,038,448 | 6/1962 | Corwin | 220/378 X |
| 3,072,022 | 1/1963 | Wood et al. | 89/1.810 X |
| 3,075,301 | 1/1963 | Fiedler et al. | 89/1.810 X |
| 3,135,162 | 6/1964 | Kamalian | 89/1.810 |
| 3,158,062 | 11/1964 | Feiler | 89/1.817 X |
| 3,160,061 | 12/1964 | Moy | 89/1.816 |
| 3,402,639 | 9/1968 | Beteille et al. | 89/1.817 X |
| 3,499,364 | 3/1970 | D'ooge | 89/1.817 X |
| 4,185,538 | 1/1980 | Barakauskas | 89/1.810 |
| 4,301,708 | 11/1981 | Mussey | 89/1.810 |
| 4,342,419 | 8/1982 | Conway | 220/357 X |
| 4,455,917 | 6/1984 | Shook | 89/1.817 |

FOREIGN PATENT DOCUMENTS

| | | | |
|---|---|---|---|
| 1245629 | 10/1960 | France | 89/1.816 |
| 316189 | 9/1956 | Switzerland | 89/1.816 |

*Primary Examiner*—Michael J. Carone
*Assistant Examiner*—Theresa M. Wesson
*Attorney, Agent, or Firm*—Charles D. Brown; Wanda Denson-Low

[57] ABSTRACT

An undersea vehicle storage and ejection system includes a capsule having a cavity therein adapted to store and launch a vehicle. The capsule has an opening at one end for passage of the vehicle therethrough. A closure member is suitably adapted to be mateable with the housing at the opening to seal the cavity. A rocket unit is incorporated within the capsule to remove the closure member at launch. The closure member includes a sealing arrangement for withstanding the hydrostatic pressure when the system is in the undersea environment of use and block the entry of sea water into the cavity. The rocket unit, when ignited, rapidly builds up pressure within the capsule to a level exceeding the external hydrostatic pressure on the cover, thereby removing the cover so that the vehicle may be launched.

20 Claims, 2 Drawing Sheets

UNDERSEA VEHICLE EJECTION FROM CAPSULES

BACKGROUND OF THE INVENTION

1. Field of the Invention

This invention relates to vehicle launching systems and, more particularly, to such systems which are adapted to the launching of vehicles stored in undersea containers, such as missiles, torpedoes, attack mines and mobile mines.

2. Description of the Prior Art

In the interest of maintaining the defenses of this nation and preserving the capability of retaliating against a possible preemptive first strike by another nation, various schemes have been proposed for the installation of intercontinental ballistic missile launch sites with a high probability of surviving a first nuclear attack. At present, the strategic retaliatory force of this country comprises three principal segments: missiles stored underground in fixed locations, preferably in missile silos hardened to protect the missile against anything but a direct hit; airborne missiles carried in bombers, some of which are always airborne or on scramble alert; and missiles on submarines such as the Polaris and Trident which are always on the move and whose location can never be determined with particular accuracy. Various schemes have been proposed to modernize these missile installations as existing missiles become obsolete and to improve their capability for surviving an initial nuclear strike, in particular to provide improved capabilities for undersea storage and launch facilities.

It has been proposed to place intercontinental ballistic missiles in undersea installations. These could be located on the continental shelf fairly remote from land, thereby avoiding the opposition raised against missile installations near human habitats. Such installations would be less likely to be detected by reconnaissance satellites with the accuracy with which ground based missiles are detected. Provision must be made, of course, to protect the missile against the hostile undersea environment. Provision must also be made for the rapid deployment of the missile for quick reaction launching where reaction time is critical.

This invention addresses underwater launch of missiles, torpedoes and mine vehicles; prior systems which are known relate only to missile applications. Quick reaction launching from an underwater storage site is particularly important for torpedoes and mine vehicles. Such vehicles have a very short range and, if they are to be successful, it is essential that they be launched to begin their run on the target immediately following detection of a target in the area. Whereas there is likely to be an interval of 15 minutes or more in which to launch an intercontinental ballistic missile following detection of the launching of enemy missiles, the situation is quite different for torpedoes and attack mines. For these underwater homing vehicles, the window of access to a target is only a few minutes at most following target detection. Each second of delay in starting the undersea vehicle on its run to the target lessens the probability of success.

A number of prior art systems are known which relate to the launching or release of vehicles from undersea storage facilities. Fiedler et al in U.S. Pat. No. 3,075,301 disclose a reusable test vehicle design involving a dummy missile for underwater launcher check-out, underwater missile trajectory testing, and personnel training. This system is principally concerned with providing a vehicle which is capable of eliminating fallback and the inherent danger of launcher damage.

Kamalian in U.S. Pat. No. 3,135,162 discloses a floating missile canister. This disclosure relates to a water-borne missile launcher, rather than an undersea launching facility, and the missile launcher comprises concentric cylindrical tubes in which a missile is stored with provision being made for removing the top and bottom end closures of the tubes prior to launching.

D'Ooge in U.S. Pat. No. 3,499,364 discloses an encapsulated missile, designed to be stored and transported in a submarine. The missile capsule is designed to provide positive buoyancy so that it will rise to the surface by flotation when it is released in preparation for launching by the firing of an explosive retaining bolt in the submarine. The nose section of the capsule is connected to the shell portion by a connector ring assembly which is broken away when emergence of the capsule from the water is detected. Thereafter, the rocket motor of the missile is ignited, generating exhaust gases which pressurize the capsule and separate the nose section from the capsule, after which the nose section is directed out of the flight trajectory of the missile.

Barakauskas in U.S. Pat. No. 4,185,538 discloses another missile launching system for releasing a missile from a submerged submarine so that the missile may be launched when it reaches the surface. The missile is stored in a double walled canister structure provided with a removable cover for protection against the undersea environment. In preparation for ejection of the missile, the cover is removed by unspecified means, after which an associated air pressurizing system is activated to eject the missile from the canister. The missile rocket is ignited after the missile has travelled a safe distance from the submarine.

Mussey in U.S. Pat. No. 4,301,708 discloses a launch tube closure which comprises frangible glass ribs and a plastic cover. A special linear-shaped explosive charge and detonator are used to destroy the launch tube closure when the missile is launched. Upon detonation of the charge, the plastic cover and glass ribs are fragmented into small granules so that the missile may exit the launch tube without obstruction.

SUMMARY OF THE INVENTION

In brief, arrangements in accordance with the present invention comprise an undersea vehicle storage and launch facility having an upright or horizontal capsule in which the vehicle is placed. A cover having a sealing arrangement for providing a hydrostatic seal is mounted on the open end of the capsule after the vehicle is installed and preparatory to delivering the capsule to its undersea installation. This hydrostatic seal effectively keeps sea water out of the capsule and away from the vehicle and is responsive to increasing hydrostatic pressure on the capsule cover with increasing depth, so that the effectiveness of the seal against external hydrostatic pressure increases commensurately.

Systems in accordance with the present invention incorporate a rocket unit, situated at the aft end of the vehicle within the capsule, as a source of combustion gases to rapidly build up pressure within the capsule to a level exceeding the hydrostatic pressure on the cover so that the cover can be removed from the sealed opening of the capsule and the vehicle can be launched. In one embodiment of the invention, this desired result may be accomplished by using a rocket-propelled vehicle, such as a missile. In other arrangements in accordance with the invention, the vehicle stored within the capsule is of a conventional undersea weapon type, such as a torpedo, attack mine, or the like. In such a case, a separate rocket unit is positioned within the capsule at the aft end of the vehicle. In either event, the pressure of the combustion gases from the rocket unit provides the force required to remove the cover and launch the vehicle from the capsule.

Upon launching, the rocket unit at the aft end of the vehicle is ignited and the rocket combustion gases cause pressure to build up very rapidly and uniformly throughout the capsule. When sufficient pressure has built up to overcome the hydrostatic force on the cover plus any frictional force developed by the hydrostatic sealing member, the cover is opened and the vehicle is ejected from the capsule. It should be pointed out that, in prior art arrangements, normally there is insufficient thrust on the missile to open the cover. In such prior art arrangements, different mechanisms are used to open the cover of a storage canister and eject the missile. By utilizing the gas pressure which is developed by the rocket firing within the capsule of the present invention, the force developed by the pressure applied over the cover area is sufficient to open the cover. The walls of the capsule and the cover are relatively thick in order to withstand the inwardly directed hydrostatic forces as well as the outwardly directed forces resulting from the firing of the rocket in the initial phase of launching the vehicle from the ocean bottom. The cover is further formed with a dome shape for added structural strength.

DESCRIPTION OF THE DRAWING

A better understanding of the present invention may be had from a consideration of the following detailed description, taken in conjunction with the accompanying drawings in which.

DESCRIPTION OF THE PREFERRED EMBODIMENT

Figure 1:
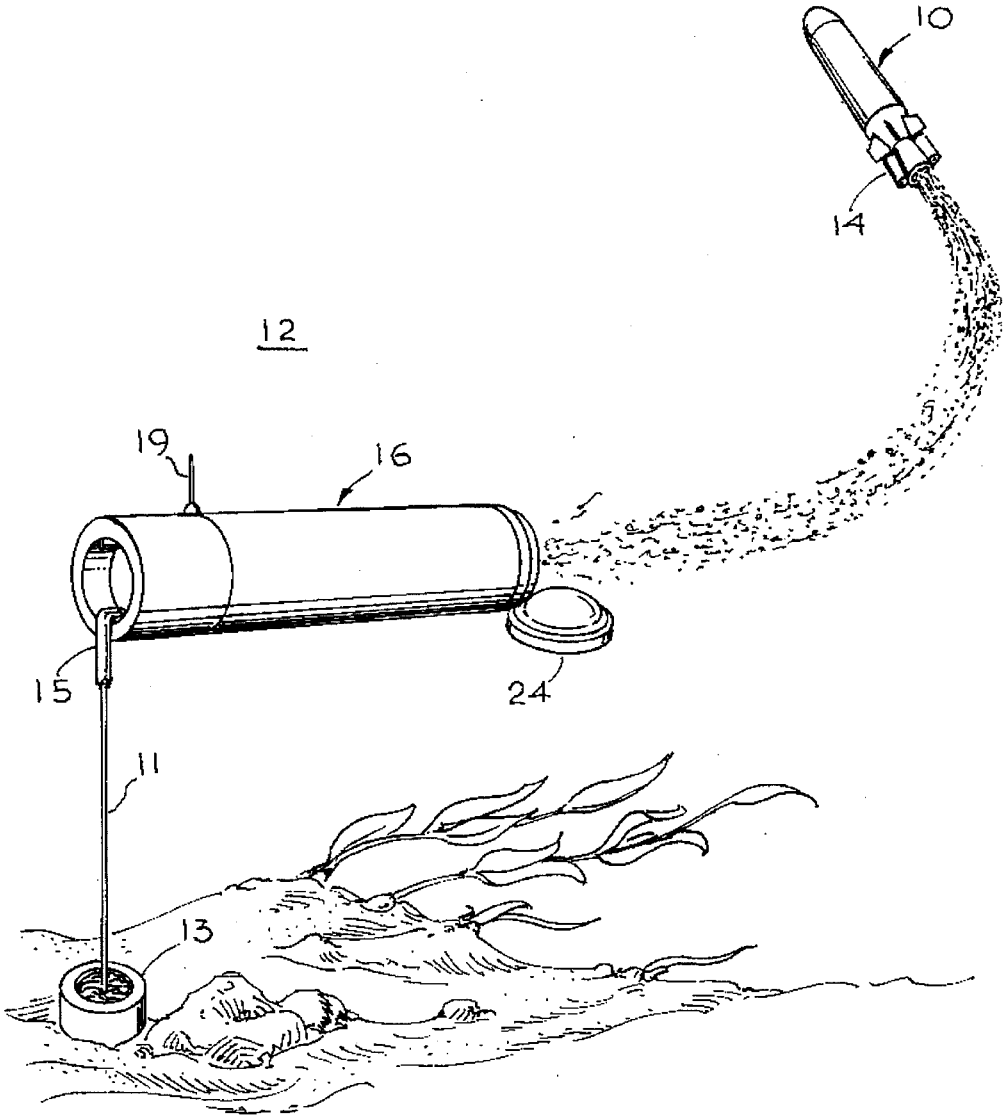
FIG. 1 is a perspective view of a capsule in accordance with the present invention, shown anchored on the sea bottom and oriented horizontally for storage and ejection of a propelled vehicle.
Figure 2:
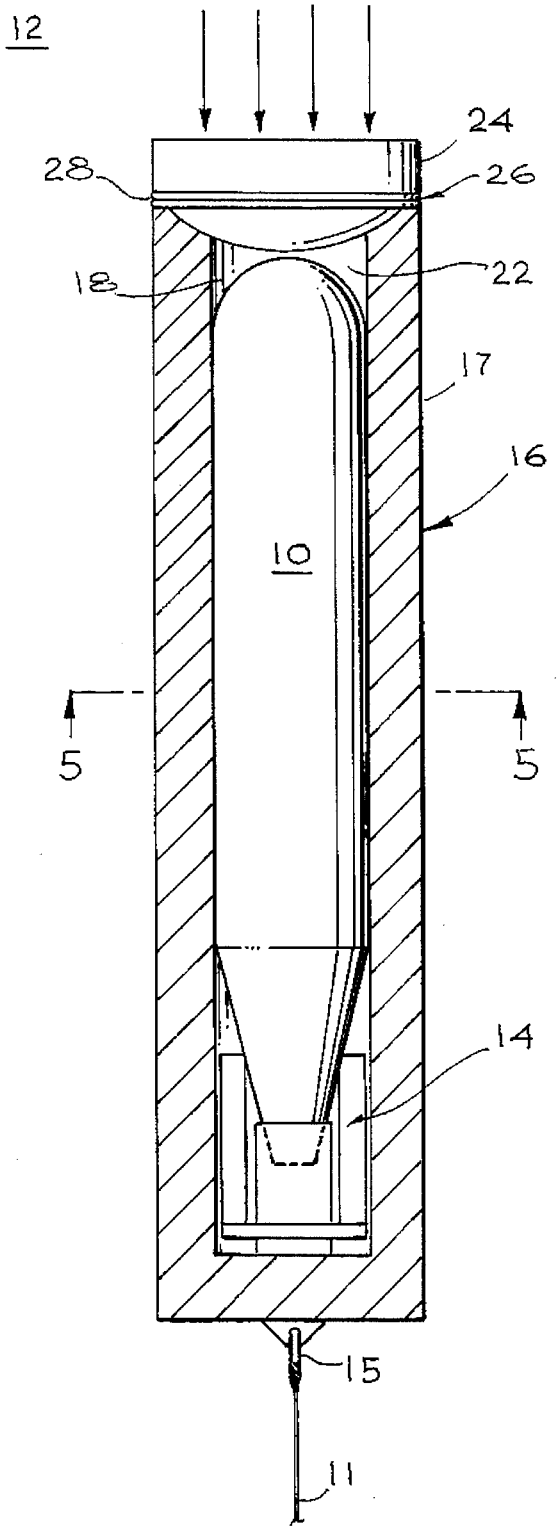
FIG. 2 is a sectional view of a capsule with vehicle housed therein, oriented in a vertical attitude.

Referring now to FIGS. 1 and 2, a vehicle 10, capable of undersea launch, is shown in conjunction with a storage and launch system generally designated by the reference numeral 12. The system 12 includes a rocket unit 14, positioned at the aft end of the vehicle 10 within a capsule 16. Where the vehicle 10 is a missile, this rocket unit 14 comprises the rocket propulsion motor of the vehicle. Where the vehicle 10 is a torpedo, as shown in FIG. 1, the rocket unit 14 is a separate assembly of one or more rockets which, when the rockets are ignited, is the source of high pressure, high temperature exhaust gases. Ideally, the rocket unit 14 is of a type which develops a rate of combustion so that the high pressure gas emissions are sufficient to offset sea water pressure. As shown in FIG. 1, the capsule 16 is held near the sea bottom by a tether 11 attached to a mooring device 13 at the bottom and to an attachment 15 which is secured to one end of the capsule 16.

In FIG. 1, the capsule 16 is shown in a horizontal attitude. The vehicle 10 has just been ejected from the capsule 16. Member 19 represents an element, such as a sonar transducer or some other detector, for relaying signals to the ignition system of the rocket unit 14. Member 19 may alternatively represent a connection to a wire line running to shore or some other location in the area for carrying the signal to ignite the rocket unit 14 and start the propulsion system of the vehicle 10. Thus the rocket unit 14 may be ignited and the vehicle 10 ejected almost immediately upon detection of a submarine or surface ship in the vicinity, to which the vehicle 10 is to be directed.

The cross-sectional view of FIG. 2 shows a capsule 16 oriented in a vertical attitude and tethered from the sea bottom by line 11 and hook 15. As shown in FIG. 2, the capsule 16 comprises a generally cylindrical housing having relatively thick walls 17, preferably of metal or some other suitable material, to withstand the external ambient pressure and to contain the internal pressure which is developed after the rocket unit 14 is fired.

The housing 16 is provided with an opening 22 which allows ingress and egress of the vehicle 10. A closure member 24 is provided as a removable sealing cover for the housing 16 near the opening 22. This sealed relationship prevents the penetration of water into the cavity 18, thus preventing the destructive effects of exposure of the vehicle 10 to such an environment. When in its environment of use and before launching of the vehicle, the hydrostatic pressure of the water acting in the direction shown by the arrows in FIG. 2 on the closure member 24 causes a sealing member 26 between the closure member 24 and the housing 16 to be compressed, since the pressure inside the sealed housing will remain essentially constant due to the constant volume of the structure while at increased depths the hydrostatic pressure will be increased substantially.

Figure 3A:
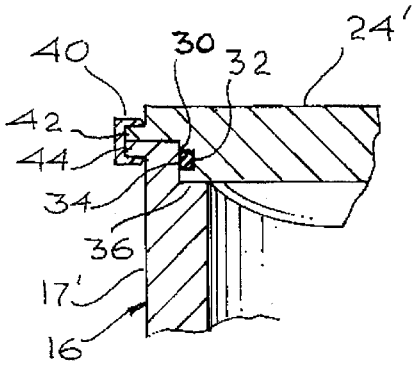
FIGS. 3A and 3B are partial sectional views, showing particular details of alternative arrangements for sealing portions of the capsule of FIGS. 1 and 2.
Figure 3B:
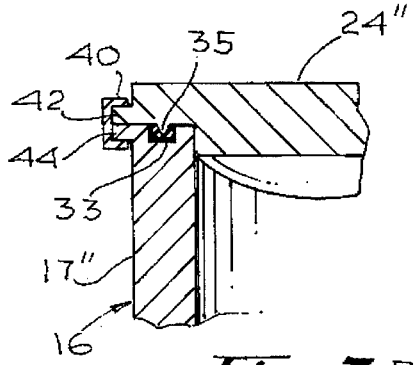

In the embodiment shown in FIG. 2, the sealing member 26 comprises a pair of surfaces and a resilient seal 28 details of which are shown in FIGS. 3A and 3B. Both the capsule 16 and the cover 24 are formed with thick walls to provide the strength needed to withstand the hydrostatic pressure at the depth at which the capsule is customarily installed. The cover is further provided with a convex shape in the form of an inverted dome approximating a chordal section of a sphere on its underside, and the circumferential wall of the capsule is bevelled along its inner surface to mate with the adjacent surface of the cover 24.

FIG. 3A shows further detail of one particular sealing arrangement which may be used in embodiments of the invention. In this figure, the cover 24' is provided with a reduced diameter section 30 having a circumferential recess 32 in which there is placed an O-ring sealing member 34. The upper portion of the capsule wall 17' is formed with an L-shaped circumferential section 36 with which the section 30 of the cover mates in sealing relationship when the cover 24' is placed in position in the capsule opening.

FIG. 3A also shows a clamping arrangement comprising a clamp 40 which is set in position over a pair of protruding lips 42, 44, lip 42 being part of the cover 24' and lip 44 being part of the capsule wall 17'. This clamping arrangement is incorporated to secure the cover 24' to the capsule during transport and lowering into the water. Once the capsule is in position, tethered to the sea bottom, the clamp 40 may be removed, since the cover is then held in place by hydrostatic pressure.

The details of the clamping and sealing arrangement shown in FIG. 3B are similar to those shown in FIG. 3A, except that the cover 24" and wall 17" are shaped slightly differently to accommodate a chevron type seal 35 within a recess 33 in the upper surface of the wall 17".

When the vehicle 10 is initially installed in the capsule 16, the clamp 40 forces the cover 24 to press the seal elements 32 or 33 against the sealing surface to establish the desired sealing arrangement to keep out the sea water. After the capsule is delivered to the ocean bottom, the increased hydrostatic pressure on the cover 24 forces the sealing elements more tightly together, thereby maintaining an effective seal without dependence upon the clamp arrangement, which can be released. When the rocket unit 14 is fired during the launch, the cover 24 is readily separable from the capsule 16, thereby permitting the vehicle 10 to exit the capsule and continue toward the target. The cover may be mounted to be entirely removed from the capsule 16, as shown in FIG. 2, or it may be attached to the capsule by a hinge, as shown in FIG. 4.

Figure 4:
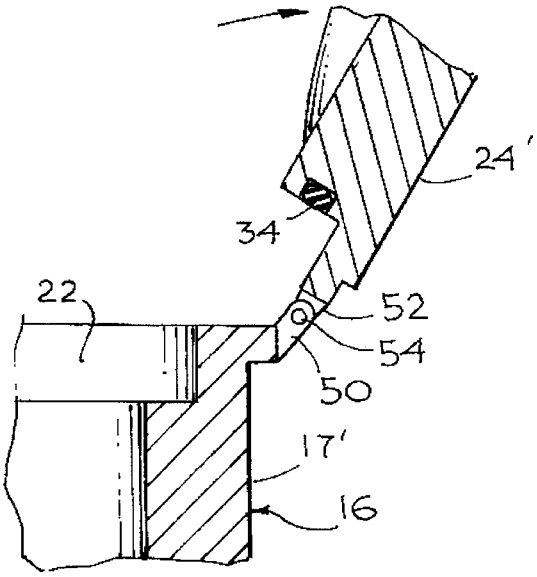
FIG. 4 is another partial sectional view showing details of another feature of the invention.

The hinge arrangement of FIG. 4, a partial sectional view of the capsule and cover, comprises a pair of hinge brackets 50, 52, fastened respectively to the capsule wall 17' and the cover 24', and pivotably engaged by pin 54.

Figure 5:
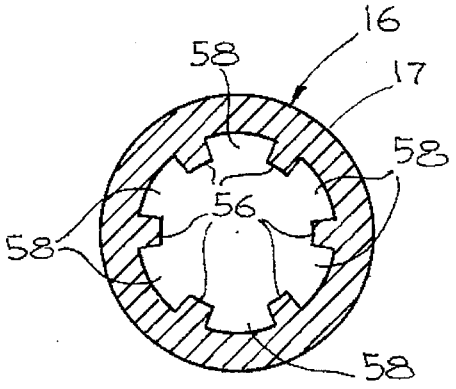
FIG. 5 is a cross-sectional view, taken along the line 5—5 of FIG. 2, showing details of particular structure of the capsule.

FIG. 5 is a horizontal cross section of the capsule 16, taken along the line 5—5 of FIG. 2, showing how the interior of the cylindrical wall 17 may be shaped to support the vehicle. The inner surface of the wall 17 is provided with a number of radially inwardly projecting, longitudinal ribs 56 defining spaces 58 which communicate between the space at the end of the capsule containing the rocket unit 14 and the cavity 18 at the opposite end. Thus, when the rocket unit 14 is fired, there is ample space for the pressure of the combustion gases to reach cavity 18 and blow off the cover 24.

Thus there has been shown and described hereinabove a system for storing and launching rocket-propelled missiles as well as torpedoes, mines and the like in an undersea environment. A capsule is provided having a removable cover which is sealed to protect the contained missile from the undersea environment. The cover is readily removable when the rocket unit is fired and pressure builds up inside the capsule to a level exceeding the sea water pressure. For example, at a depth of 100 feet, the hydrostatic pressure is approximately 46 pounds per square inch gauge (psig). Arrangements in accordance with the present invention develop an equal pressure within the capsule in approximately 200 milliseconds. Thus, the rapid build up of the pressure within the capsule reaches a level where the cover is removed from the capsule opening and the vehicle is launched in less than a second. The sealing arrangement which is provided effectively blocks the entrance of sea water into the capsule during undersea storage yet permits the cover to be easily removed from the capsule opening when the vehicle is launched.

Although there has been described above one specific arrangement of an undersea storage and ejection system for vehicles in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Apparatus for undersea launch of a vehicle comprising:

a vehicle enclosing housing having a cavity therein adapted to support the vehicle in a launch attitude and means defining an opening at one end to permit passage of the vehicle into and out of the housing;

means for retaining the vehicle enclosing housing at a selected depth in a body of water;

removable closure means for mating with the housing at the opening to prevent penetration of water into the housing cavity when the housing is submerged; and rocket propulsion means for pressurizing the cavity, upon ignition, to a pressure level sufficient to overcome ambient hydrostatic pressure, forcibly open the closure means and permit rocket thrust to launch the vehicle through said opening into the surrounding water.

2. The apparatus of claim 1 wherein the opening at one end of the housing is the only opening in the housing.

3. The apparatus of claim 1 wherein the rocket propulsion means is positioned adjacent the end of the housing remote from said opening.

4. The apparatus of claim 3 wherein the rocket propulsion means comprises the rocket motor of a rocket-propelled vehicle stored within the housing.

5. The apparatus of claim 3 wherein the rocket propulsion means comprises a rocket unit mounted between the vehicle and said remote end of the housing.

6. The apparatus of claim 5 wherein the vehicle to be launched is a self-propelled undersea weapon.

7. The apparatus of claim 3 wherein the interior surface of the housing is formed with a plurality of passages extending longitudinally along the cavity wall to adjacent the opening and communicating with the rocket propulsion means to permit combustion gases from the rocket propulsion means to pressurize the portion of the cavity adjacent the closure means.

8. The apparatus of claim 7 wherein said passages are individually bounded by longitudinal ribs extending inwardly from the interior wall of the housing to support the vehicle within the housing away from said interior wall surfaces.

9. The apparatus of claim 1 wherein the closure means comprises a cover extending across the upper end of the housing to close the opening thereof.

10. The apparatus of claim 9 further including a hinge member pivotably securing the cover to the housing adjacent the opening.

11. The apparatus of claim 9 wherein the closure means further includes sealing means for sealing the juncture between the cover and the upper end of the housing.

12. The apparatus of claim 11 further including removable clamping means for retaining the cover in sealing relationship over the opening of the housing during placement of the apparatus in an undersea location.

13. The apparatus of claim 12 wherein the clamping means comprises matching circumferential protuberances on the cover and the housing, respectively, and a generally C-shaped clamp gripping the two protuberances.

14. The apparatus of claim 11 wherein the sealing means comprises a pair of mating seal surfaces, one on the underside of the cover and the other on the upper surface of the housing surrounding the opening, and a resilient sealing member between said surfaces.

15. The apparatus of claim 14 wherein the sealing member is generally circular in shape, is fabricated of a resilient material, and is effective, when the cover is in place, to establish a hydrostatic seal.

16. The apparatus of claim 15 wherein the seal sufaces are aligned with each other when the cover is in place with adjacent surfaces in contact, and wherein the seal surfaces are readily separable to permit the cover to be ejected upon the build up of excess pressure within the cavity from exhaust gases developed by the ignition of the rocket propulsion means.

17. The apparatus of claim 15 wherein the sealing member comprises a chevron type seal extending about the upper periphery of the housing at the opening and mounted within a recess in the sealing surface of the housing.

18. The apparatus of claim 15 wherein the sealing member comprises an O-ring extending about the cover in a circumferential recess therein.

19. The apparatus of claim 18 wherein the seal surface of the housing is generally L-shaped, facing radially inward adjacent the upper surface of the housing surrounding the opening.

20. The apparatus of claim 19 wherein the mating surface of the cover is shaped to match the L-shaped surface of the housing, the O-ring and associated recess facing outwardly to bear against the inwardly facing portion of the L-shaped surface.

* * * * *